US005302575A

United States Patent [19]

Nogawa et al.

[11] Patent Number: 5,302,575

[45] Date of Patent: Apr. 12, 1994

[54] IMAGE RECEIVING MEDIUM FOR USE WITH SUBLIMATION TYPE THERMAL IMAGE TRANSFER RECORDING MEDIUM

[75] Inventors: Chiharu Nogawa, Shizuoka; Naoya Morohoshi, Numazu; Hiroyuki Uemura, Numazushi; Hidehiro Mochizuki, Numazu; Hiroki Kuboyama, Mishima; Yutaka Ariga, Fuji, all of Japan

[73] Assignee: Ricoh Company, Ltd., Tokyo, Japan

[21] Appl. No.: 240

[22] Filed: Jan. 4, 1993

[30] Foreign Application Priority Data

Jan. 8, 1992 [JP] Japan ..... 4-019587
Aug. 10, 1992 [JP] Japan ..... 4-234322
Nov. 25, 1992 [JP] Japan ..... 4-339816

[51] Int. Cl.[5] ..... B41M 5/035; B41M 5/38

[52] U.S. Cl. ..... 503/227; 428/195; 428/206; 428/240; 428/246; 428/260; 428/265; 428/320.2; 428/323; 428/402; 428/913; 428/914

[58] Field of Search ..... 8/471; 428/195, 207, 428/913, 914, 206, 224, 240, 245, 260, 265, 320.2, 323, 402, 246; 503/227

[56] References Cited

U.S. PATENT DOCUMENTS 4,505,975 3/1985 Majima ..... 428/336

*Primary Examiner*—B. Hamilton Hess
*Attorney, Agent, or Firm*—Oblon, Spivak, McClelland, Maier & Neustadt

[57] ABSTRACT

An image receiving medium for use in combination with a sublimation type thermal image transfer recording medium with a sublimation-type dye containing image transfer layer is composed of a substrate including a sheet made of a fibrous material and a polymeric material in the form of partcles or a porous resin, the polymeric material or the porous resin being located in the interstices within the fibrous material; and a dye receiving layer formed the substrate.

29 Claims, 2 Drawing Sheets

IMAGE RECEIVING MEDIUM FOR USE WITH SUBLIMATION TYPE THERMAL IMAGE TRANSFER RECORDING MEDIUM

BACKGROUND OF THE INVENTION

1. Field of the Invention

The present invention relates to an image receiving medium to be used in combination with a sublimation type thermal image transfer recording medium comprising a sublimation-type-dye containing image transfer layer.

2. Discussion of Background

Conventionally, a laminated material is employed as an image receiving medium for use in sublimation type thermal image transfer recording. The laminated material comprises a substrate such as a sheet of synthetic paper, high quality paper, art paper, or coated paper, or a polyester film, and a dye receiving layer formed on the substrate. The dye receiving layer comprises as the main component a material such as a thermoplastic polyester resin having strong dyeing properties with respect to a sublimation-type dye and is provided on the substrate, for example, by coating.

Japanese Laid-Open Patent Application 3-83686 discloses an image receiving medium for use in sublimation type thermal image transfer, which comprises a substrate such as a sheet of high quality paper, art paper, coated paper, synthetic-resin-impregnated, or emulsion-impregnated paper, or a film of a synthetic resin such as polyolefin, polyethylene terephthalate or polystyrene; and a dye receiving layer comprising a vinyl resin or a polyester resin, formed on the substrate.

When the substrate of such an image receiving medium is not a sheet of paper, but a resin film, however, there are the shortcomings that the handling properties are poor because the substrate made of a resin does not have a paper-like touch, and that the manufacturing cost thereof is high. On the other hand, when a sheet of paper such as coated paper is employed as the substrate of the image receiving sheet, voids or irregularities are formed on the surface of the image receiving sheet, because the substrate is made of a fibrous material. As a result, a sublimation type dye contained in an image transfer layer of a sublimation type thermal image transfer recording medium cannot be clearly transferred imagewise to the dye receiving layer of the image receiving sheet, and non-image-transferred portions are formed in the images obtained.

SUMMARY OF THE INVENTION

It is therefore an object of this invention to provide an image receiving medium for use with a sublimation type thermal image transfer recording medium, which is free from the above-mentioned conventional shortcomings, and is capable of producing clear transferred images thereon without the formation of non-image-transferred portions thereon.

This object of the present invention can be achieved by an image receiving medium for use in combination with a sublimination type thermal image transfer recording medium comprising a sublimination-type dye containing image transfer layer, which image receiving medium comprises: (a) a substrate comprising a sheet made of a fibrous material and a polymeric material in the form of particles or a porous resin, the polymeric material or the porous resin being located in the interstices within the fibrous material; and (b) a dye receiving layer formed on the substrate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

The image receiving medium according to the present invention is completely different from the conventional image receiving medium in the structure of the substrate by which the shortcomings of the conventional image receiving medium can be eliminated.

Figure 1:
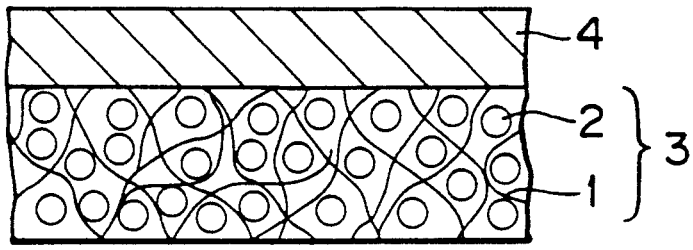
FIG. 1 is a schematic cross-sectional view of a first embodiment of an image receiving medium according to the present invention which is used in combination with a sublimation type thermal image transfer recording medium.

FIG. 1 is a cross-sectional view of a first embodiment of an image receiving medium according to the present invention. As shown in FIG. 1, a dye receiving layer 4 is provided on a substrate 3 comprising a sheet made of a fibrous material 1 and a polymeric material in the form of particles 2. The particles of the polymeric material 2 are embedded in the interstices within the fibrous material 1.

A sheet of a fibrous material, which is an essential component of the substrate of the image receiving medium of the present invention, can be fabricated by making a fibrous material in the form of a sheet in accordance with a conventional method. Examples of the fibrous material include natural vegetable fiber such as hemp, wood pulp and bark fiber; and chemical fiber such as synthetic pulp, reprocessed pulp, fibers of synthetic resins such as polyethylene terephthalate, polyester, polyolefin, and polystyrene; and glass fiber. Of these, the fibers of a synthetic resin such as polyethylene terephthalate and natural fiber of hemp are more preferably employed in the present invention. These fibrous materials can be made into a fiber by means of a conventional method such as melt spinning. It is preferable that the fibrous materials employed to form a substrate be white or colorless, although they may be colored.

It is preferable that a sheet made of the above-mentioned conventionally known fibrous materials have a voidage in the range of 20 to 90 vol. %, and a thickness in the range of 5 to 500 μm.

Specific examples of a sheet made of such a fibrous material include a sheet of paper such as Japanese paper, and machine-made paper; a sheet of synthetic paper surface-treated to give the appearance of paper; and a non-woven fabric made of synthetic resin fiber. In particular, the non-woven fabric made of the synthetic resin fiber is preferred in the present invention.

In the present invention, it is preferable that the sheet made of the fibrous material have a density of 0.6 $g/cm^3$ or less, and more preferably in the range from about 0.20 to 0.50 $g/cm^3$. In the fibrous material with such a low density as mentioned above, there are ample spaces between the fibers, so that the fibrous material itself is movable even by the application of a small force thereto.

In the substrate for use in the present invention, a polymeric material in the form of particles or a porous resin can be embedded in the aforementioned sheet of the fibrous material. It is preferable that the particles of the polymeric material be hollow, although they may be solid or porous.

In addition to the above, it is preferable to use the particles of a thermally expandable polymeric material, each particle containing a low-boiling point material therein. When the above-mentioned particles of the thermally expandable polymeric material are embedded into the interstices within the fibrous material, and expanded by the application of heat thereto, the interstices within the fibrous material can be completely filled with the particles, and the particles can well be held in the interstices with high integrity.

Figure 2:
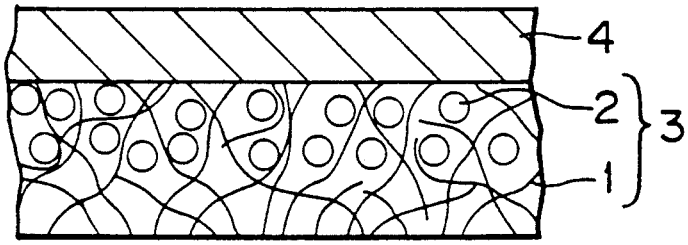
FIG. 2 is a schematic cross-sectional view of a second embodiment of an image receiving medium according to the present invention.

In addition to the above embodiment shown in FIG. 1, a polymeric material in the form of particles 2 or a porous resin may be embedded in the interstices of a fibrous material 1 only on the side of a dye receiving layer 4 as shown in FIG. 2. For instance, a substrate obtained by laminating a first sheet made of a fibrous material in which a polymeric material in the form of particles is embedded in the spaces within the fibrous material, and a second sheet made of a fibrous material in which a polymeric material is not embedded therein can be employed in the image receiving medium of the present invention. In this case, a dye receiving layer is formed on the first sheet side.

Figure 3:
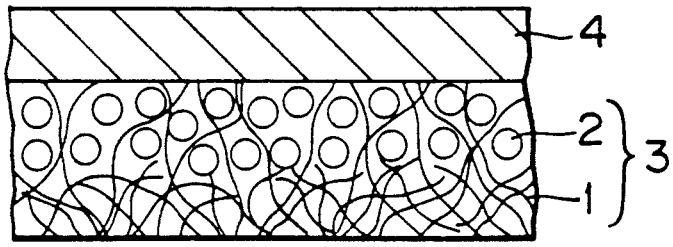
FIG. 3 is a schematic cross-sectional view of a third embodiment of an image receiving medium according to the present invention.

In the substrate of the image receiving medium as shown in FIG. 2 according to the present invention, it is preferable that the voidage of the fibrous material 1 in which the polymeric material in the form of particles 2 or the porous resin is embedded be higher than that of the fibrous material 1 in which the polymeric material or porous resin is not embedded, as shown in FIG. 3. For example, a laminated material of the aforementioned first sheet made of a fibrous material and the aforementioned second sheet whose voidage is made lower than that of the first sheet can be used as a substrate, with the first sheet placed on the dye receiving layer side. The rigidity of the image receiving medium can be increased so that the occurrence of curling thereof can be minimized by use of the above-mentioned substrate.

Conventional polymeric materials in the form of particles can be employed in the substrate for use in the present invention. Specific examples of the particles of the polymeric material are as follows:

(1) Particles of thermally expandable thermoplastic resin

These particles are void particles comprising as a shell a thermoplastic resin such as vinylidene chloride-acrylonitrile copolymer. Each particle contains therein as a blowing agent a volatile liquid such as propane, n-butane, or isobutane. The volatile liquid contained in these particles is expanded when thermal energy is applied to the particles, so that expanded polymeric hollow particles are formed.

Specific examples of the above-mentioned thermally expandable thermoplastic resin particles include commercially available products "Matsumoto·Microsphere F30" (Trademark), made by Matsumoto Yushi-Seiyaku Company Ltd., and "Expancel 551" and "Expancel 642" (Trademarks), made by Chemanovel Co., Ltd.

(2) Micro-capsuled particles of polymeric material

Micro-capsuled particles of a polymeric material for use in the present invention comprise as a shell a rigid resin such as acryl-styrene copolymer. Each particle contains water therein, and the water springs out of the shell when the micro-capsuled particles are dried by the application of heat, whereby these particles become hollow. For example, commercially available product "Ropaque OP-84J" (Trademark), made by Rohm and Haas, Japan K.K., can be used as the above-mentioned particles.

In the substrate for use in the present invention, a porous resin having minute bubbles therein may be embedded in the interstices within the fibrous material. Examples of the porous resin are polyurethane, polyester, polyvinyl chloride, epoxy resin, cellulose acetate, and polysulfone. These porous resins can be obtained in accordance with a conventional method, for example, by utilizing the difference in solubility or volatility of a solvent employed; or mixing a resin and an oil having no compatibility with the resin.

It is convenient that the particle size of the polymeric material or the porous resin embedded in the interstices within the fibrous material be smaller than the mesh size of the fibrous material made into a sheet for the substrate. In general, it is preferable that the particle size of the polymeric material or the porous resin be about 1/100 to ½, more preferably about 1/50 to 1/5 the mesh size of the fibrous material.

A liquid adhesive agent comprising the previously mentioned polymeric material in the form of particles or porous resin is impregnated into a sheet of fibrous material by a conventional method, such as a dipping method or a roll coating method, followed by drying the liquid adhesive agent with the application of heat, so that the polymeric material in the form of particles or the porous resin can be embedded in the interstices within the fibrous material of the sheet. It is preferable that the content of the polymeric material in the form of particles or the porous resin in the adhesive agent be in the range of 1 to 70 wt. %, more preferably in the range of 10 to 50 wt. %. Conventional liquid adhesive agents can also be employed in the present invention.

Examples of an adhesive component for use in the above-mentioned adhesive agent are carboxymethylcellulose, sodium alginate, starch, casein, polyvinyl alcohol, polyethylene oxide, polyvinyl pyrrolidone, acrylate, methacrylate, ethylene-vinyl acetate copolymer, polyurethane, and epoxy resin.

It is preferable that the mixing ratio by parts by weight of the adhesive component to the polymeric material in the form of particles or the porous resin be in the range of 0.01 to 10 parts by weight of the adhesive agent to one part by weight of the polymeric material or the porous resin, more preferably in the range of 0.05 to 5 parts by weight of the adhesive agent to one part by weight of the polymeric material or the porous resin, and further more preferably in the range of 0.05 to 0.5 parts by weight of the adhesive agent to one part by weight of the polymeric material or the porous resin.

A liquid adhesive agent which does not dissolve the polymeric material in the form of particles or the porous resin is preferably employed in the present invention. The liquid adhesive agent may be an aqueous solution, a solution by use of an organic solvent, or an emulsion.

In the liquid adhesive agent containing a polymeric material in the form of particles or the porous resin, it is preferable that the adhesive component thereof have resistance to organic solvents. When an adhesive component with the resistance to organic solvents is employed for the liquid adhesive agent, the adhesive component adheres to the surfaces of the particles of the polymeric material or porous resin, so that a protective layer with the resistance to organic solvents can be formed on the surfaces of the particles. When a coating liquid for forming a dye receiving layer, comprising an organic solvent, is coated on the substrate, the particles of the polymeric material or porous resin covered with the above-mentioned protective layer can be prevented from being dissolved in the organic solvent, even though the organic solvent for use in the dye receiving layer coating liquid comes into contact with the particles of the polymeric material or porous resin contained in the substrate.

In the present invention, an intermediate resin layer may be provided between the substrate and the dye receiving layer. By the provision of the intermediate resin layer, the organic solvent in the dye receiving layer coating liquid does not come into contact with the polymeric material or porous resin in the substrate in the formation of the dye receiving layer. In this case, it is unnecessary the adhesive component of the liquid adhesive agent have resistance to organic solvents, and as such an adhesive component, a resin such as polyethylene oxide is preferably used.

Any polymer with excellent film-forming properties and resistance to organic solvents, which can restrain the penetration of organic solvents used for the formation of the dye receiving layer into the particles of the polymeric material or porous resin, can be employed as the adhesive component. Specific examples of such an adhesive component include water-soluble polymers such as polyvinyl alcohol, casein, and starch; acrylic acid ester; ethylene-vinyl acetate copolymer; and carboxyl group-containing polyethylene. Of these, polyvinyl alcohol, casein, and starch are preferably employed from the viewpoint of the effect of the resistance to organic solvents.

Figure 4:
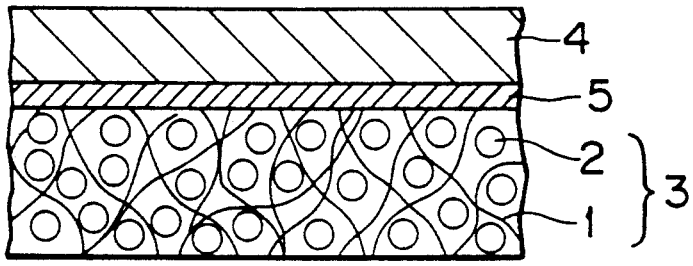
FIG. 4 is a schematic cross-sectional view of a fourth embodiment of an image receiving medium according to the present invention.

FIG. 4 is a cross-sectional view of a fourth embodiment of an image receiving medium of the present invention.

The image receiving medium shown in FIG. 4 further comprises an intermediate resin layer 5, which is interposed between a substrate 3 and a dye receiving layer 4, in order to improve the barrier properties and smoothness of the surface with which a dye receiving layer coating liquid is coated, and to prevent the formation of non-image-transferred portions in the transferred image in the course of an image transfer step.

Figure 5:
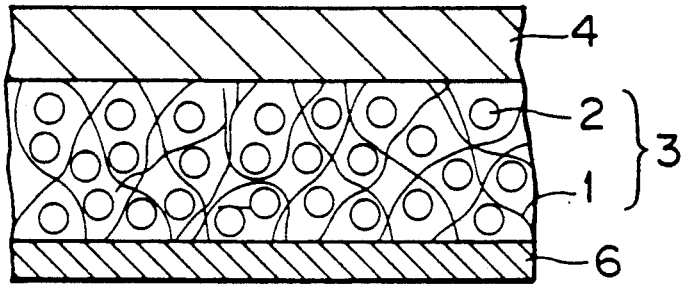
FIG. 5 is a schematic cross-sectional view of a fifth embodiment of an image receiving medium according to the present invention.

Moreover, when necessary, a back resin layer 6 may be provided on the back side of the substrate 3, opposite to the dye receiving layer 4 with respect to the substrate 3, as shown in FIG. 5. By the provision of the back resin layer 6, the polymeric material in the form of particles 2 or porous resin embedded in the interstices within a fibrous material 1 in the substrate 3 can be prevented from falling off the substrate 3, the curling of the image receiving medium can be minimized even when the image receiving medium is heated in the course of thermal image transfer recording, and the transportation properties of the image receiving medium can be improved.

Figure 6:
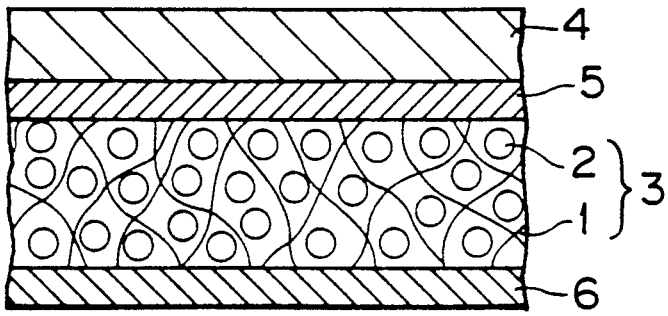
FIG. 6 is a schematic cross-sectional view of a sixth embodiment of an image receiving medium according to the present invention.

Furthermore, FIG. 6 shows a cross-sectional view of a sixth embodiment of the image receiving medium according to the present invention. As shown in the figure, the intermediate resin layer 5 is interposed between the substrate 3 and the dye receiving layer 4, and the back resin layer 6 is provided on the back side of the substrate 3, opposite to the intermediate resin layer 5 with respect to the substrate 3.

Examples of the resin used for the intermediate resin layer 5 and the back resin layer 6 are thermoplastic resins such as polyester, vinyl chloride-vinyl acetate copolymer, acrylic resin, polyvinyl acetate, ethylene-vinyl acetate copolymer, alkyl titanate resin, vinyl acetate-acrylic copolymer, polyethyleneimine, polyvinyl chloride, polybutadiene, polyethylene, ethylene-acrylic copolymer, polypropylene, ionomer resin, polystyrene, and polyurethane elastomer; thermosetting resins such as polyurethane, and epoxy resin. In particular, solvent-resistant resins are preferably employed of the above-mentioned resins. In addition to the above, an ultraviolet curing resin, an electron radiation curing resin, a rubber such as styrene-butadiene copolymer can be employed for the formation of the intermediate resin layer 5 and the back resin layer 6.

When necessary, additives, for instance, a curing agent, a wax such as paraffin wax, and a surface-active agent may be added to the above-mentioned resin. The resins for use in the intermediate resin layer 5 and the back resin layer 6 may be the same or different.

The intermediate resin layer 5 and the back resin layer 6 for use in the present invention can be formed not only by the conventionally known methods such as solution coating, but also by the extrusion coating, and hot melt coating method. Alternatively, a resin for use in the intermediate resin layer 5 and/or the back resin layer 6 may be shaped into a film, and then the thus obtained film may be attached to at least one side of the substrate by heat bonding or by use of an adhesive agent. In the case where the intermediate resin layer 5 and/or the back resin layer 6 are formed by the above method, preferable resins for these resin layers are a polyester resin such as polyethylene terephthalate; polyolefin; polyvinyl chloride; polystyrene; polycarbonate; and an acrylic resin such as polymethyl methacrylate.

In the present invention, it is preferable that the intermediate resin layer 5 and the back resin layer 6 have a thickness in the range of 0.1 to 300 μm, and more preferably in the range of 1 to 200 μm. When the thickness of the intermediate resin layer 5 and the back resin layer 6 is in the range of 0.1 to 300 μm, an excellent barrier effect against the coating liquid for the dye receiving layer, and the smoothness of each resin layer can be obtained.

A conventional dye receiving layer can be used in the present invention. For the formation of the dye receiving layer, at least one resin with a polarity, such as polyester, polyamide, acrylic resin, acetate resin, polystyrene resin, or vinyl chloride-vinyl acetate copolymer resin may be dissolved in an organic solvent such as toluene, benzene, xylene, or methyl ethyl ketone to prepare a coating liquid for the dye receiving layer 4. The coating liquid for the dye receiving layer 4 may be coated on the substrate 3 or the intermediate resin layer 5 in an amount of about 2 to 10 g/m$^2$ on a dry basis. It is preferable that the thickness of the dye receiving layer 4 be in the range of 0.5 to 50 μm.

Furthermore, after the intermediate resin layer 5 is coated on the substrate and dried, or the dye receiving layer 4 is superimposed on the substrate 3, the laminated material may be subjected to smoothing treatment such as supercalendering for the purpose of the improvement of appearance and smoothness of the dye receiving layer.

If necessary, antistatic treatment may be performed on the front and/or the back side of the obtained image receiving medium by use of a surface-active agent, thereby the transportation properties of the image receiving medium while in use can be improved.

Other futures of this invention will become apparent in the course of the following description of exemplary embodiments, which are given for illustration of the invention and are not intended to be limiting thereof.

EXAMPLE 1

Formation of Substrate

A non-woven fabric made of polyester (Trademark "05TH-48", made by Hirose Seishi Co., Ltd.) with a density of 0.449 g/cm$^3$) was impregnated with a coating liquid A with the following formulation and dried, so as to incorporate the coating liquid A in an amount of 10 g/m$^2$ on a dry basis, whereby a fibrous sheet impregnated with the coating liquid A was prepared.

Formulation of Coating Liquid A

| | Parts by Weight |
|---|---|
| Polymeric material in the form of hollow particles (Trademark "Matsumoto-Microsphere MF30-C", made by Matsumoto Yushi-Seiyaku Company, Ltd.; average particle diameter: 15 μm) | 57 |
| Polyethylene oxide (Trademark "Alkox R-400", made by Meisei Chemical Works, Ltd.) | 2 |
| Water | 14.0 |

After the completion of the drying of the fibrous sheet impregnated with the coating liquid A, the fibrous sheet was heated to 130° C. for minutes to expand the polymeric material in the form of hollow particles therein, whereby a substrate was fabricated.

Formation of Dye Receiving Layer

A coating liquid B with the following formulation was coated on the above obtained substrate, so that a dye receiving layer with a thickness of 6 μm was formed on the substrate.

Formulation of Coating Liquid B

| | Parts by Weight |
|---|---|
| Vinyl chloride-vinyl acetate-vinyl alcohol copolymer (Trademark "Denka Vinyl #1000GKT", made by Denki Kagaku Kogyo K.K.) | 18 |
| Silicone resin (Trademark "AY42-125", made by Dow Corning Toray Silicone Co., Ltd.) | 4.5 |
| Toluene | 39 |
| Methyl ethyl ketone | 39 |

Thus, an image receiving medium No. 1 according to the present invention was obtained.

EXAMPLE 2

A white PET (polyethylene terephthalate) film with a thickness of 20 μm, serving as an intermediate resin layer, was provided on the same substrate as employed in Example 1, and the same dye receiving layer as employed in Example 1 was provided on the white PET film in the same manner as in Example 1, whereby an image receiving medium No. 2 according to the present invention was obtained.

EXAMPLE 3

The procedure for preparation of the image receiving medium in Example 1 was repeated except that a white PET film with a thickness of 20 μm, serving as an intermediate resin layer, was interposed between the substrate and the dye receiving layer employed in Example 1 in the same manner as in Example 2, and another PET film with a thickness of 20 μm, serving as a back resin layer, was formed on the substrate, opposite to the intermediate resin layer with respect to the substrate, whereby an image receiving medium No. 3 according to the present invention was obtained.

EXAMPLE 4

The procedure for preparation of the image receiving medium in Example 1 was repeated except that a white PET film with a thickness of 20 μm, serving as a back resin layer, was formed on the substrate, opposite to the dye receiving layer with respect to the substrate, whereby an image receiving medium No. 4 according to the present invention was obtained.

EXAMPLE 5

Preparation of Substrate

A high-quality paper with a thickness of 70 μm and a density of 0.77 g/cm$^3$, serving as a sheet made of a fibrous material, was impregnated with a coating liquid C with the following formulation and dried, followed by the application of heat thereto at 60° C. for 100 hours, whereby a substrate was fabricated.

Formulation of Coating Liquid C

| | Parts by Weight |
|---|---|
| Polyurethane-based W/O emulsion (Trademark "UF-1000NO", made by Sanyo Chemical Industries, Ltd.) | 100 |
| Methyl ethyl ketone | 35 |
| Isocyanate ("Coronate L", | 3 |

-continued

| | Parts by Weight |
|---|---|
| made by Nippon Polyurethane Industry Co., Ltd.) | |
| Water | 50 |

Preparation of Dye Receiving Layer

The coating liquid B employed in Example 1 was coated on the above fabricated substrate, so that a dye receiving layer with a thickness of 6 μm was formed on the substrate, whereby an image receiving medium No. 5 according to the present invention was obtained.

EXAMPLE 6

The procedure for preparation of the image receiving medium No. 5 in Example 5 was repeated except that the high-quality paper employed in Example 5 was replaced by a non-woven fabric made of polyester (Trademark "05TH-48", made by Hirose Paper Co., Ltd., with a density of 0.45 g/cm$^3$), so that an image receiving medium No. 6 according to the present invention was obtained.

EXAMPLE 7

Preparation of Substrate

A non-woven fabric made of polyester (Trademark "05TH-48", made by Hirose Paper Co., Ltd., with a density of 0.45 g/cm$^3$), serving as a sheet made of a fibrous material, was impregnated with a coating liquid D with the following formulation and dried, followed by the application of heat thereto at 60° C. for 100 hours, whereby a substrate was fabricated.

Formulation of Coating Liquid D

| | Parts by Weight |
|---|---|
| Polyurethane W/O emulsion ("Haimlen" (Trademark), made by Dainichiseika Color and Chemicals Mfg. Co., Ltd.) | 100 |
| Methyl ethyl ketone | 20 |
| Toluene | 20 |
| Water | 30 |

Preparation of Dye Receiving Layer

The coating liquid B employed in Example 1 was coated on the above fabricated substrate, so that a dye receiving layer with a thickness of 6 μm was formed on the substrate, whereby an image receiving medium No. 7 according to the present invention was obtained.

EXAMPLE 8

A non-woven fabric made of polyester (Trademark "05TH-48", made by Hirose Seishi Co., Ltd.) with a density of 0.449 g/cm$^3$ was impregnated with a coating liquid E with the following formulation and dried, so as to incorporate the coating liquid E in an amount of 10 g/m$^2$ on a dry basis, whereby a fibrous sheet impregnated with the coating liquid E was prepared:

Formulation of Coating Liquid E

| | Parts by Weight |
|---|---|
| Polymeric material in the form of hollow particles (Trademark "Matsumoto-Microsphere MF30-C", made by Matsumoto Yushi-Seiyaku Company, Ltd.; average particle diameter: 15 μm) | 7 |
| Polyvinyl alcohol (Trademark "RFM-17") | 5 |
| Water | 15 |

After the completion of the drying of the fibrous sheet impregnated with the coating liquid E, the fibrous sheet was heated to 130° C. for 3 minutes to expand the polymeric material in the form of hollow particles therein, whereby a first sheet was prepared. This first sheet was subjected to supercalendering.

Subsequently, the thus prepared first sheet was laminated with another non-woven fabric made of polyester (Trademark "05TH-48", made by Hirose Seishi Co., Ltd.) with a density of 0.449 g/cm$^3$ which was the same non-woven fabric as that employed for the first sheet, but was not impregnated with the coating liquid E, serving as a second sheet, whereby a substrate was fabricated.

Formation of Dye Receiving Layer

The coating liquid B employed in Example 1 was coated on the first sheet side of the above fabricated substrate with a thickness of 6 μm, and dried, so that a dye receiving layer was formed on the substrate. Thus, an image receiving medium No. 8 according to the present invention was prepared.

EXAMPLE 9

The procedure for preparation of the image receiving medium No. 8 in Example 8 was repeated except that the non-woven fabric made of polyester (Trademark "05TH-48", made by Hirose Seishi Co., Ltd. employed as the first sheet in Example 8 was replaced by a non-woven fabric made of polyester (Trademark "15TH-100", made by Hirose Seishi Co., Ltd.), and that the non-woven fabric made of polyester (Trademark "05TH-48") employed as the second sheet in Example 8 was replaced by a high-quality paper (Trademark "PPC paper Type 6000", made by Ricoh Company, Ltd.), so that an image receiving medium No. 9 according to the present invention was fabricated.

EXAMPLE 10

The procedure for preparation of the image receiving medium No. 8 in Example 8 was repeated except that the non-woven fabric made of polyester (Trademark "05TH-48") employed as the second sheet in Example 8 was replaced by a high quality paper (Trademark "PPC paper Type 6000", made by Ricoh Company, Ltd.), and that a white PET film was laminated on the high quality paper, whereby an image receiving medium No. 10 according to the present invention was fabricated.

Preparation of image transfer recording medium

A 6 μm thick PET film serving as a substrate, provided with a silicone curing resin film with a thickness of about 1 μm, serving as a back layer, was prepared.

A mixture of the following components was coated on the above substrate, opposite to the back layer, so that a thermal image transfer layer with a thickness of 2 μm was formed on the substrate:

| | Parts by Weight |
|---|---|
| Polyvinyl butyral (Trademark "BX-1", made by Sekisui Chemical Co., Ltd.) | 10 |
| Sublimation type disperse cyan dye (Trademark "Kayaset 714", made by Nippon Kayaku Co., Ltd.) | 6 |
| Methyl ethyl ketone | 45 |
| Toluene | 45 |

Thus, a thermal image transfer recording medium was prepared.

Each of the above obtained image receiving media Nos. 1 to 10 according to the present invention and the above prepared thermal image transfer recording medium were superimposed in such a fashion that the dye receiving layer of each of the image receiving media Nos. 1 to 10 came into contact with the image transfer layer of the thermal image transfer recording medium, and thermal energy was applied to the back side of the image transfer medium, opposite to the image transfer layer, by use of a thermal head for image recording. The recording density of the thermal head was 6 dot/mm, and the recording output thereof was 0.42 W/dot. The results are shown in Table 1.

Furthermore, the formation of the non-image-transferred portions and the features of the external appearance of each of the image receiving media No. 1 to No. 10 were inspected. The results of the inspection are also shown in Table 1.

TABLE 1

| | Formation of Non-image-transferred Portions | Falling off of Polymeric Material in the form of Particles or Porous Resin | Curling of Printed Image Receiving Medium |
|---|---|---|---|
| Example 1 | ○ | x | x |
| Example 2 | ⊙ | x | Δ |
| Example 3 | ⊙ | ○ | ○ |
| Example 4 | ○ | ○ | Δ |
| Example 5 | ○ | ○ | ○ |
| Example 6 | ⊙ | ○ | ○ |
| Example 7 | ⊙ | ○ | ○ |
| Example 8 | ⊙ | ○ | Δ |
| Example 9 | ⊙ | ○ | ○ |
| Example 10 | ⊙ | ○ | ○ |

Evaluations
Formation of non-image-transferred portions:
⊙ Not observed at all
○ Slightly observed
Falling off of the polymeric material in the form of particles or the porous resin:
x Observed
○ Not observed
Curling of printed image receiving medium:
x A rise of 2 or more cm from a horizontal surface when placed thereon.
Δ A rise of 1 to 2 cm from a horizontal surface when placed thereon.
○ A rise of less then 1 cm from a horizontal surface when placed thereon.

As is obvious from the results shown in Table 1, the formation of non-image-transferred portions is successfully prevented in the image receiving media according to the present invention.

More specifically, in the case of the image reciving media Nos. 3 and 4, each comprising the back resin layer, the polymeric material in the form of particles did not fall off the substrate, and no substantial curling took place.

In the case of the image receiving medium No. 3 comprising both the intermediate resin layer and the back resin layer, the formation of the non-image-transferred portions, the falling off of the polymeric material in the form of particles, and the curling of the image receiving medium were most effectively prevented.

In the case of the image receiving medium No. 2, since the intermediate resin layer is interposed between the dye receiving layer and the substrate, the effect of preventing the formation of non-image-transferred portions can be obtained to the same extent as in the case of the image receiving medium No. 3 in Example 3, but the image receiving medium No. 2 was inferior to the image receiving medium No. 3 with respect to the falling off of the polymeric material in the form of particles and the curling degree thereof.

Moreover, the image receiving medium No. 9 which comprises the substrate including the paper with a low voidage and the image receiving medium No. 10 comprising the PET film as the intermediate resin layer exhibited excellent curling preventing effect.

In the image receiving medium according to the present invention, no plastics film is employed as the substrate of the image receiving medium, but a fibrous sheet such as non-woven fabric is employed for the substrate. Therefore, the image receiving medium is featured by having a paper-like touch. The cost of the image receiving medium is low.

Furthermore, in comparison with the case where plain paper or coated paper is employed for the substrate, the formation of non-image-transferred portions is less. This is because the polymer particles or the porous resin is located in the interstices within the fibrous sheet, on the dye receiving layer side of the sheet in the substrate, so that the cushioning properties and heat accumulation properties of the substrate are significantly improved.

When a resin layer is interposed between the dye receiving layer in the image receiving medium according to the present invention, the resin layer not only exhibits a barrier effect for preventing the polymer particles container in the substrate from being dissolved in the solvent contained in the dye receiving layer during the provision of the dye receiving layer on the substrate, but also improve the smoothness and appearance of the substrate. Therefore, when such a resin layer is provided between the dye receiving layer and the substrate, the effect of preventing the formation of non-image-transferred images can be significantly improved.

By the provision of a resin layer on the back side of the substrate, the resin particles can be prevented from falling off from the interstices of the substrate and the curling of the image receiving medium during the heat application thereto can be prevented. Furthermore, by adding an appropriate antistatic agent to the resin layer, the charging of the image receiving medium can be prevented, whereby the transportation properties of the image receiving medium can be improved.

Furthermore, by setting the voidage of the fibrous material in the substrate on the side remote from the dye receiving layer lower than the voidage of the fibrous material in the substrate on the side close to the dye receiving layer, the rigidity of the image receiving medium can be increased and the occurrence of the curling of the image receiving medium can be minimized.

What is claimed is:

1. An image receiving medium for use in combination with a sublimation type thermal image transfer recording medium comprising a sublimation dye containing image transfer layer, said image receiving medium comprising:

(a) a substrate comprising a sheet made of a fibrous material and a polymeric material in the form of particles or a porous resin, said polymeric material or said porous resin being located in the interstices within said fibrous material; and (b) a dye receiving layer formed on said substrate.

2. The image receiving medium as claimed in claim 1, further comprising an intermediate resin layer between said substrate and said dye receiving layer.

3. The image receiving medium as claimed in claim 2, further comprising a back resin layer formed on said substrate, opposite to said dye receiving layer.

4. The image receiving medium as claimed in claim 2, wherein said sheet made of a fibrous material is a non-woven fabric made of a synthetic resin fiber.

5. The image receiving medium as claimed in claim 2, wherein said sheet made of a fibrous material has a density of 0.6 g/cm$^3$ or less.

6. The image receiving medium as claimed in claim 2, wherein said polymeric material in the form of particles or said porous resin is located in the interstices of said fibrous material facing said dye receiving layer.

7. The image receiving medium as claimed in claim 2, wherein said polymeric material in the form of particles is in the form of hollow particles.

8. The image receiving medium as claimed in claim 2, wherein said porous resin is prepared by use of a water-in-oil emulsion comprising a resin, an organic solvent, and water.

9. The image receiving medium as claimed in claim 1, further comprising a back resin layer formed on said substrate, opposite to said dye receiving layer.

10. The image receiving medium as claimed in claim 9, wherein said sheet made of a fibrous material is a non-woven fabric made of a synthetic resin fiber.

11. The image receiving medium as claimed in claim 9, wherein said sheet made of a fibrous material has a density of 0.6 g/cm$^3$ or less.

12. The image receiving medium as claimed in claim 9, wherein said polymeric material in the form of particles or said porous resin is located in the interstices of said fibrous material facing said dye receiving layer.

13. The image receiving medium as claimed in claim 9, wherein said polymeric material in the form of particles is in the form of hollow particles.

14. The image receiving medium as claimed in claim 9, wherein said porous resin is prepared by use of a water-in-oil emulsion comprising a resin, an organic solvent, and water.

15. The image receiving medium as claimed in claim 1, wherein said sheet made of a fibrous material is a non-woven fabric made of a synthetic resin fiber.

16. The image receiving medium as claimed in claim 15, wherein said sheet made of a fibrous material has a density of 0.6 g/cm$^3$ or less.

17. The image receiving medium as claimed in claim 15, wherein said polymeric material in the form of particles or said porous resin is located in the interstices of said fibrous material facing said dye receiving layer.

18. The image receiving medium as claimed in claim 15, wherein said polymeric material in the form of particles is in the form of hollow particles.

19. The image receiving medium as claimed in claim 15, wherein said porous resin is prepared by use of a water-in-oil emulsion comprising a resin, an organic solvent, and water.

20. The image receiving medium as claimed in claim 1, wherein said sheet made of a fibrous material has a density of 0.6 g/cm$^3$ or less.

21. The image receiving medium as claimed in claim 20, wherein said polymeric material in the form of particles or said porous resin is located in the interstices of said fibrous material facing said dye receiving layer.

22. The image receiving medium as claimed in claim 20, wherein said polymeric material in the form of particles is in the form of hollow particles.

23. The image receiving medium as claimed in claim 20, wherein said porous resin is prepared by use of a water-in-oil emulsion comprising a resin, an organic solvent, and water.

24. The image receiving medium as claimed in claim 1, wherein said polymeric material in the form of particles or said porous resin is located in the interstices of said fibrous material facing said dye receiving layer.

25. The image receiving medium as claimed in claim 24, wherein the voidage of said fibrous material in said substrate in which said polymeric material in the form of particles or said porous resin is located is higher at said dye receiving layer side than at the other portion of said fibrous material in said substrate.

26. The image receiving medium as claimed in claim 25, wherein said polymeric material in the form of particles is in the form of hollow particles.

27. The image receiving medium as claimed in claim 24, wherein said polymeric material in the form of particles is in the form of hollow particles.

28. The image receiving medium as claimed in claim 1, wherein said polymeric material in the form of particles is in the form of hollow particles.

29. The image receiving medium as claimed in claim 1, wherein said porous resin is prepared by use of a water-in-oil emulsion comprising a resin, an organic solvent, and water.

* * * * *

UNITED STATES PATENT AND TRADEMARK OFFICE

CERTIFICATE OF CORRECTION

PATENT NO. : 5,302,575

DATED : April 12, 1994

INVENTOR(S) : Chiharu NOGAWA, et al.

It is certified that error appears in the above-identified patent and that said Letters Patent is hereby corrected as shown below:

Column 1, line 39, "paper-like touch.", should read --paper-like touch,--;
line 43, "receiving sheet.", should read --receiving sheet,--.

Column 4, line 2, "resin", should read --resin:--;
line 19, "material", should read --material:--.

Column 7, line 38, "g/cm$^3$)", should read --g/cm$^3$--.

Column 11, line 60, "reciving", should read --receiving--.

Column 12, line 39, "container", should read --contained--.

Signed and Sealed this

Twenty-fifth Day of April, 1995

*Attest:*

*Attesting Officer*

BRUCE LEHMAN

*Commissioner of Patents and Trademarks*